US007370772B2

(12) United States Patent
Brunson

(10) Patent No.: US 7,370,772 B2
(45) Date of Patent: May 13, 2008

(54) LARGE TOUGH CASE EXTENSION CASE COVER LATCH

(75) Inventor: Mark E Brunson, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 545 days.

(21) Appl. No.: 10/955,976

(22) Filed: Sep. 30, 2004

(65) Prior Publication Data

US 2006/0065658 A1 Mar. 30, 2006

(51) Int. Cl.
*B65D 45/16* (2006.01)

(52) U.S. Cl. ..... 220/326

(58) Field of Classification Search ..... 220/326, 220/826, 819, 827, 823, 822, 254.6, 254.5, 220/254.3, 254.2, 254.1, 255, 324, 256.1; 292/150, 175, 138, 163, 145, 146, 302, DIG. 11, 292/DIG. 63, 137, 169; 361/683; 16/258
See application file for complete search history.

(56) References Cited

U.S. PATENT DOCUMENTS 3,199,305 A * 8/1965 Frohbieter ..... 62/135
3,578,156 A * 5/1971 Norby ..... 206/406
4,126,366 A * 11/1978 Handler et al. ..... 312/249.2
4,365,490 A * 12/1982 Manzoni ..... 70/70
4,571,456 A 2/1986 Paulsen et al.
4,677,832 A 7/1987 Remington
4,690,439 A 9/1987 Park
4,875,721 A 10/1989 Okamoto et al.
5,193,891 A * 3/1993 Headley ..... 312/348.3
5,272,832 A * 12/1993 Marshall et al. ..... 43/131
5,341,926 A * 8/1994 Leben ..... 206/307
5,957,286 A 9/1999 Ho
6,077,069 A * 6/2000 Fairbanks et al. ..... 431/153
6,115,239 A 9/2000 Kim
6,311,340 B1 11/2001 Thompson
6,502,868 B1 1/2003 Laspa et al.
6,535,380 B1 3/2003 Lee et al.
2002/0162842 A1* 11/2002 Pangerc et al. ..... 220/524
2002/0171228 A1* 11/2002 Kady ..... 280/655

FOREIGN PATENT DOCUMENTS

DE 20314261 11/2003
DE 10359266 7/2004

* cited by examiner

*Primary Examiner*—Anthony D. Stashick
*Assistant Examiner*—Robert J Hicks
(74) *Attorney, Agent, or Firm*—Harness, Dickey & Pierce, P.L.C.

(57) ABSTRACT

A storage container includes a first container portion and a second container portion hingedly attached to the first container portion. A latch is slidably disposed on the first container portion. The latch includes a pair of engaging members extending therefrom. The latch is moveable between a locked position wherein the engaging members engage the first container portion to the second container portion and an unlocked position wherein the engaging members disengage the first container portion from the second container portion. The latch is subjected to a first biasing force adapted to inhibit movement of the latch in a first direction and a second biasing force adapted to inhibit movement of the latch in a second direction. Movement of the latch into the unlocked position is accomplished by sequential movement of the latch in the first direction followed by movement of the latch in the second direction.

18 Claims, 4 Drawing Sheets

LARGE TOUGH CASE EXTENSION CASE COVER LATCH

FIELD OF THE INVENTION

The present invention relates to storage containers and more particularly to a latch configuration on a storage container.

BACKGROUND OF THE INVENTION

Storage containers exist in many varieties and may be used to store, organize and transport various items such as fasteners, tool bits and other accessories. When used to store tool bits, fasteners or accessories on a job site, a storage container must be built to be strong and durable so that if it is dropped, it does not break open and spill its contents. Storage containers often include a base portion and a cover portion hingedly connected to the base portion.

In some instances a latch configuration may be employed on a storage container to locate hinged portions, such as a base and cover, between a locked and unlocked position. Such latch configurations may include hook or clasp arrangements and may be actuated by pivoting, sliding or other movement. While known arrangements have proven satisfactory for their intended purpose, a need exists in the art to improve upon available latch configurations. Therefore, it is desirable to provide a robust latch configuration for a storage container that is easy to operate.

SUMMARY OF THE INVENTION

A storage container includes a first container portion and a second container portion hingedly attached to the first container portion. A latch is slidably disposed on the first container portion. The latch includes a pair of engaging members extending therefrom. The latch is moveable between a locked position wherein the engaging members engage the first container portion to the second container portion and an unlocked position wherein the engaging members disengage the first container portion from the second container portion.

According to other features, the latch defines a main body portion having opposite ends, wherein each of the pair of engaging members extend from the opposite ends respectively. The latch includes a user actuated portion extending from the main body portion adjacent to an outer surface of the first container portion. The main body portion of the latch extends adjacent to an inner surface of the first container portion. The inner surface of the first container portion includes a plurality of extension portions collectively defining a track. The main body portion is slidably disposed in the track and selectively translatable in the track between the locked and unlocked positions.

The latch is subjected to a first biasing force adapted to inhibit movement of the latch in a first direction and a second biasing force adapted to inhibit movement of the latch in a second direction. Movement of the latch into the unlocked position is accomplished by sequential movement of the latch in the first direction followed by movement of the latch in the second direction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
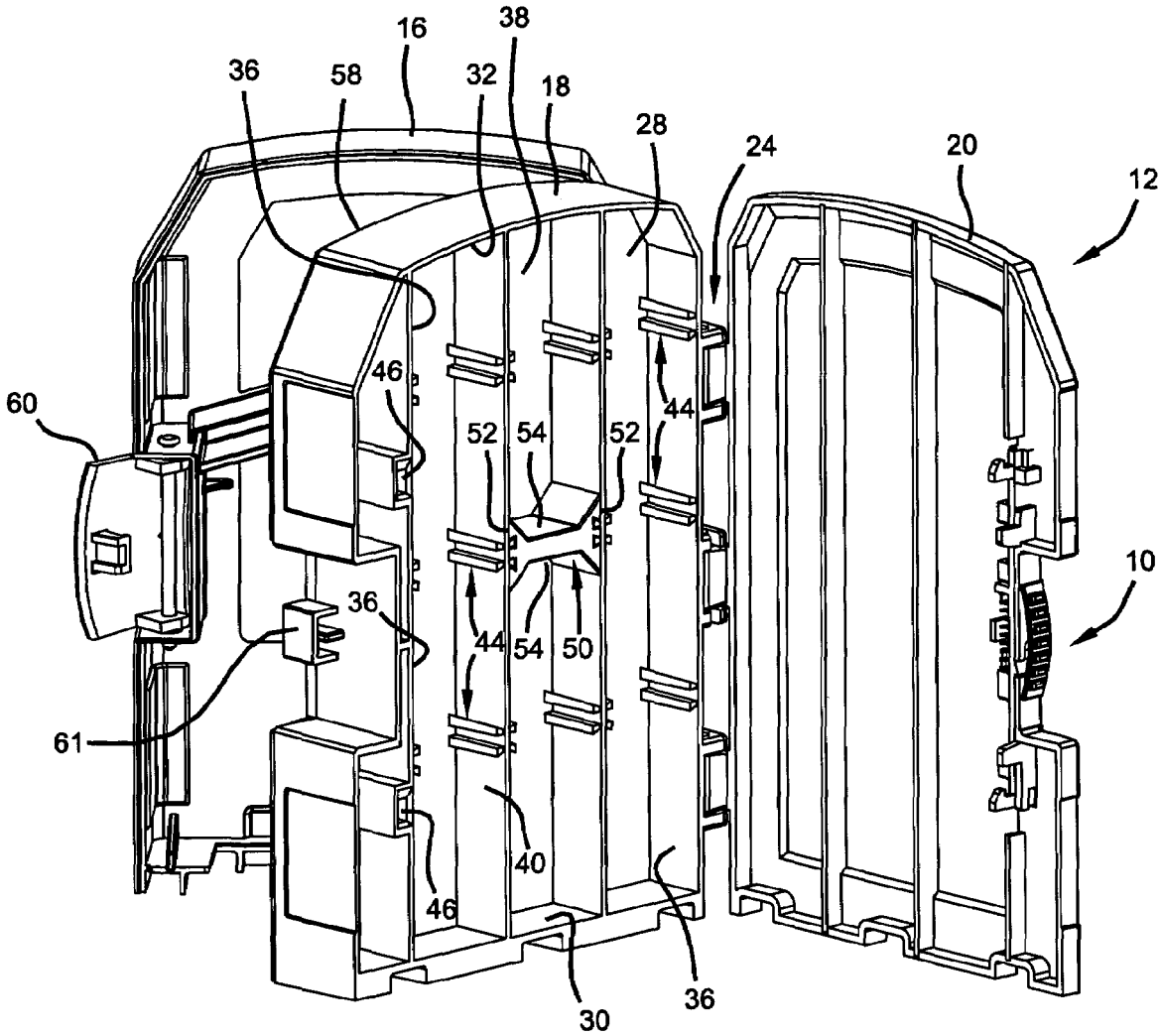
FIG. 1 is a perspective view of a latch assembly constructed according to the present invention and shown operatively associated with a storage container.

With initial reference to FIG. 1, a latch assembly 10 constructed in accordance with the present invention is shown operatively associated with a storage container 12. The storage container 12 generally includes a base container portion 16, an intermediate container portion 18 and a lid portion 20. A hinge 24 operably couples the respective portions 16, 18 and 20 of the storage container 10 and allows independent relative rotation between the base container portion 16, intermediate container portion 18 and lid portion 20. As will be described more fully herein, the latch assembly 10 is movable between a locked position for securing the lid portion 20 to the intermediate container portion 18 and an unlocked position for permitting rotation of the lid portion 20 relative the intermediate container portion 18 about the hinge 24.

With continued reference to FIG. 1, the container 10 will be described in greater detail. The intermediate container portion 18 includes a first inner cavity 28 collectively defined by a bottom wall 30, a top wall 32, side walls 36 and a back wall 38. Parallel dividers 40 extend between the bottom and top wall 30 and 32, respectively across the first inner cavity 28. Tabs 44 are configured on the parallel dividers 40 and the side walls 36 to capture a removable spacer 50. The removable spacer 50 includes opposite ends 52 and first and second sides 54. The first and second sides 52 and 54 are flared outwardly at the opposite ends 52. The removable spacer 50 may be selectably positioned within the inner cavity 28 between respective opposing tabs 44 to customize interior space. The intermediate container portion 18 includes a pair of pockets 46 for accepting portions of the latch assembly 10 in a locked position.

The base container portion 16 is configured much the same as the intermediate container portion 18 and includes a second inner cavity 58. A closure member 60 is pivotally coupled to the base container portion 16 and selectively engages a catch 61 on the intermediate container portion 18 to secure the base 16 and intermediate container portions 18 together.

Figure 2:
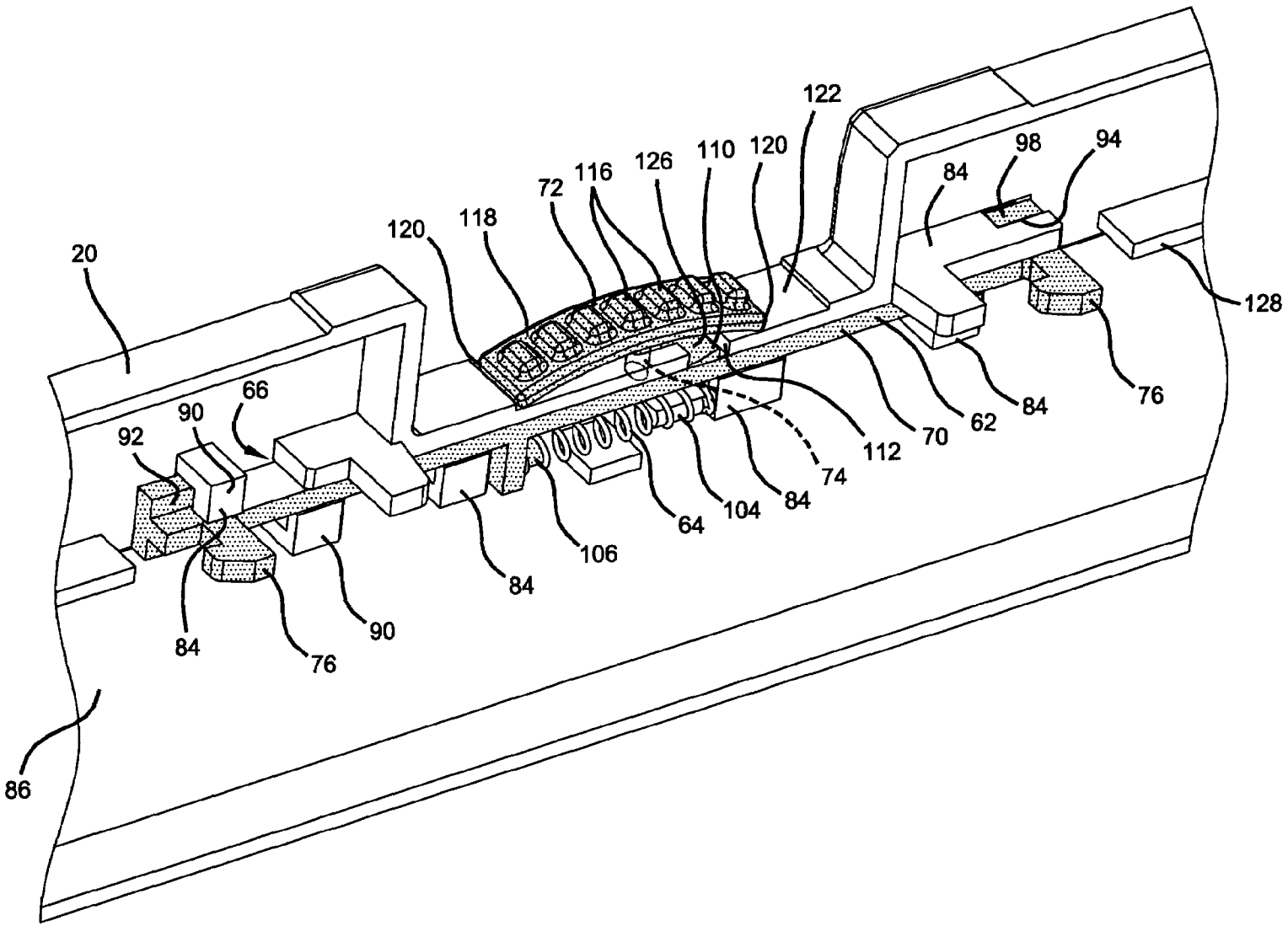
FIG. 2 is a detail view of the latch assembly of FIG. 1 shown in a locked position.

With continued reference to FIG. 1 and further reference to FIG. 2, the latch assembly 10 will be described in greater detail. The latch assembly 10 generally includes a latch 62, a biasing member 64 and a track 66 configured on the lid portion 20 of the storage container 12. The latch 62 includes a longitudinally extending main body portion 70 connected to a user actuated portion 72 by a connecting bar 74. A pair of engaging members 76 extend from opposite ends of the main body portion 70 of the latch 62 for selectively engaging retaining walls 80 (as best illustrated in FIG. 4C) formed in the respective pockets 46 of the intermediate container portion 18. Of note, the main body portion 70 of the latch 62 extends approximately one-half of the height of the container 12. As a result, the span of the latch 62 separates the engaging members 76 by a wide band width. The wide band width of the engaging members 76 and complimentary retaining walls 80 of the pockets 46 provide a robust configuration that discourages unlocking of the latch 62 such as during an impact. The biasing member 64 is illustrated as a conventional coil spring but may comprise other suitable configurations.

The track 66 is defined by a plurality of extension portions 84 configured on an inner face 86 of the lid portion 20. The latch 62 is slidably captured by the track 66 and movable toward an unlocked position along its longitudinal axis. A series of extension portions 84 define hooks 90 extending at right angles for capturing a first lateral finger 92 of the latch 62. A notch 94 is formed in one of the extension portions 84 for accepting a second lateral finger 98 of the latch 62. The biasing member 64 is located between a first post 104 formed on one of the extension portions 84 and a second post 106 arranged along an intermediate portion of the main body 70 of the latch 62. A locating finger 110 is formed on the main body portion 70 for engaging a contact surface 112 defined on the lid portion 20 in a safety position as will be described.

The user actuated portion 72 defines a series of nubs 116 arranged thereon to facilitate a gripping action on its surface. The user actuated portion 72 further defines an arcuate body 118 having opposite ends 120 engaging a slide surface 122 on the lid portion 20 of the container 12.

Figure 3A:
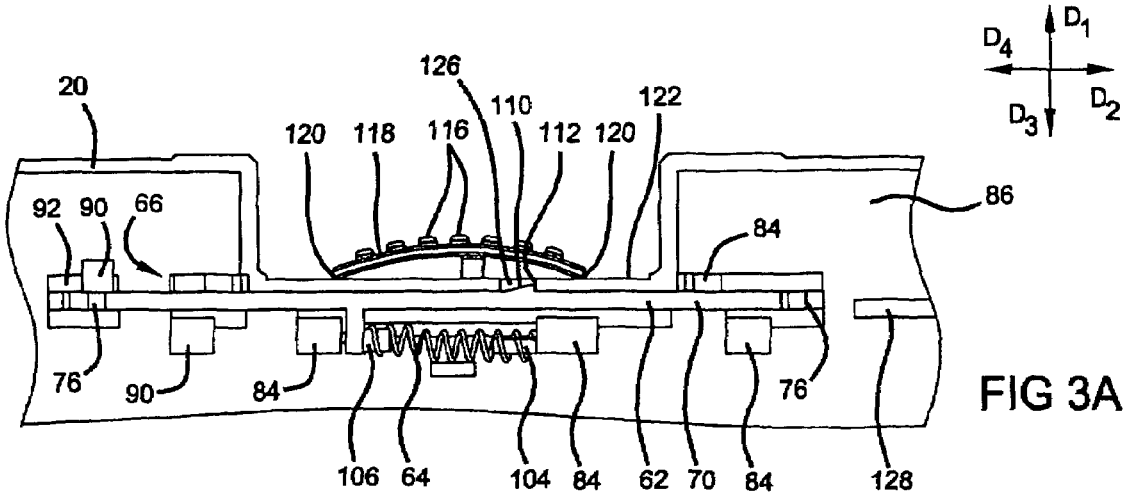
FIG. 3A is a top view of the latch assembly shown in a locked position.

Turning now to FIG. 3A, the latch assembly 10 will be described in the safety position. In an at-rest position, the opposite ends 120 of the arcuate body 118 engage the slide surface 122 of the lid portion 20 and provide a biasing force that influences the main body portion 70 of the latch 62 in an outward direction $D_1$. As a result, the locating finger 110 operably nests in a receiving gap 126 defined by the lid portion 20. The locating finger 110 is bound on a first end by the contact surface 112 of the lid portion 20. In this way, movement of the latch 62 toward the unlocked position (direction $D_2$) is precluded.

Figure 3B:
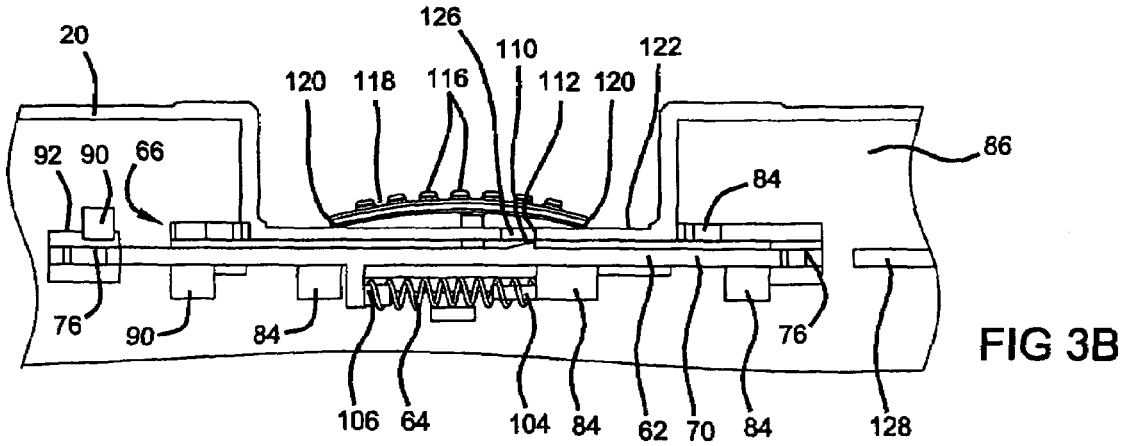
FIG. 3B is a top view of the latch assembly of FIG. 3A shown with a user actuated portion partially deflected toward a release position.

With reference to FIG. 3B, a method for moving the latch 62 out of the safety position of FIG. 3A will be described. To move the latch 62 out of the safety position, the biasing force of the user actuated portion 72 must be overcome. In this way, a user pushes on the arcuate body 118 of the user actuated portion 72 in a direction $D_3$. Such movement deflects the ends 120 of the user actuated portion outward (directions $D_2$ and $D_4$, respectively) until the locating finger 110 attains adequate clearance from the contact surface 112.

Figure 3C:
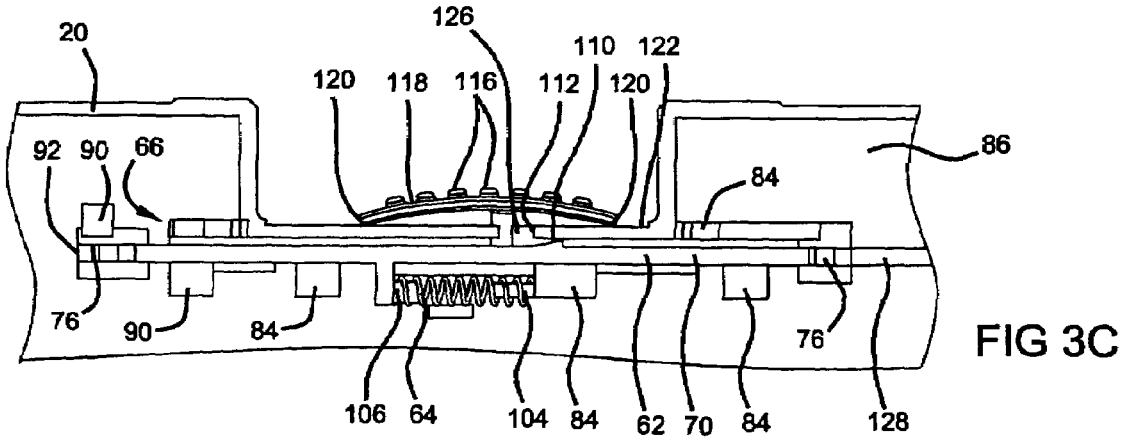
FIG. 3C is a top view of the latch assembly of claim 3B shown moving toward an unlocked position.

Once adequate clearance is gained, the user actuated portion 72 may be moved in the direction $D_2$ and toward the unlocked position (FIG. 3C). The latch may be translated along the track 66 until engaging a stopping member 128 formed on the inner face 86 of the lid 20. Movement toward the unlocked position requires overcoming the biasing force of the spring 64.

The latch assembly 10 of the present invention provides a robust configuration that resists inadvertent actuation and unlocking of the lid 20. More specifically, a sequence of distinct directional movements, each overcoming a separate biasing force is required to move the latch into the unlocked position. The first movement requires a user to push the user actuated portion in the direction $D_3$ while overcoming the biasing force of the arcuate body 118 engaging the slide surface 122. The second movement requires the user to translate the user actuated portion in the direction $D_2$ while overcoming the biasing force of the spring 64.

Figure 4A:
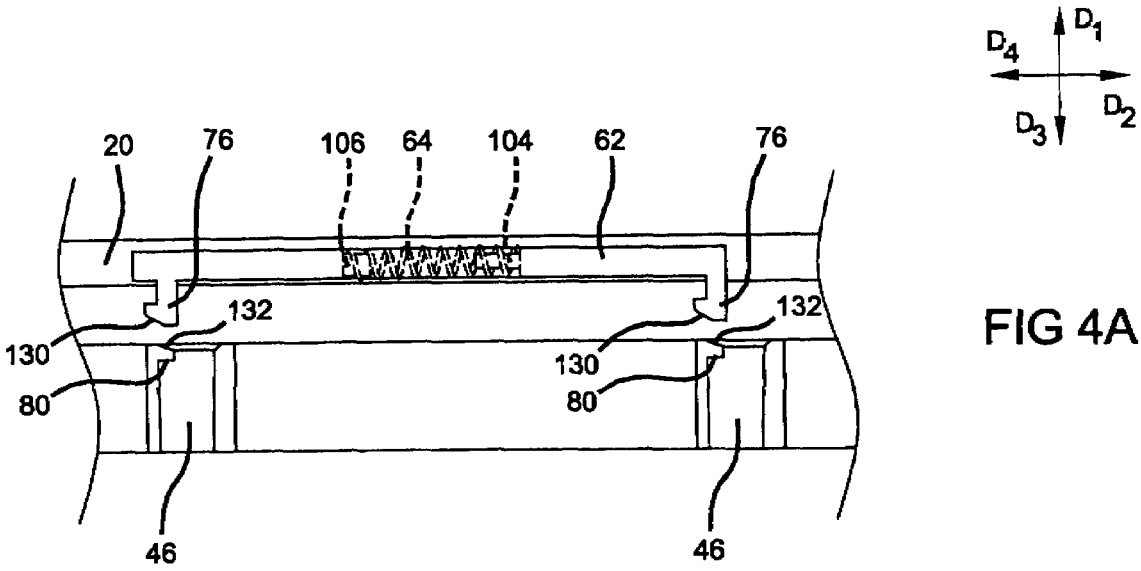
FIG. 4A is a side view of a main body portion of the latch assembly of FIG. 2 shown in an unlocked position.
Figure 4B:
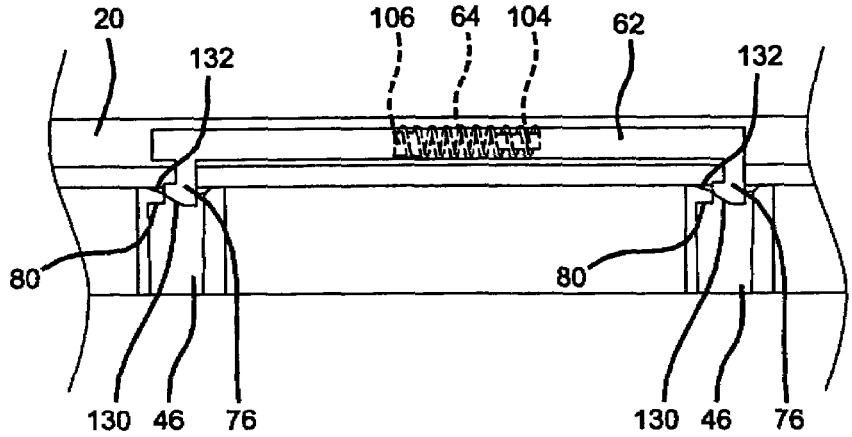
FIG. 4B is a side view of the main body portion of the latch assembly of FIG. 4A shown moving toward engagement with retaining walls formed on a container portion of the storage container.
Figure 4C:
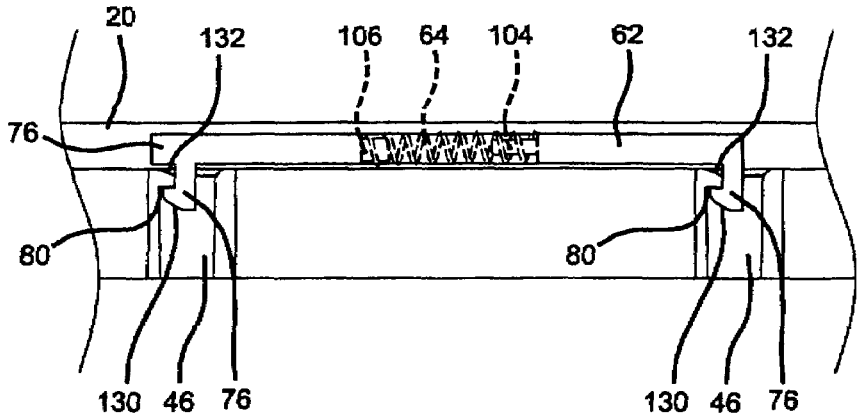
FIG. 4C is a side view of the main body portion of the latch assembly of FIG. 4B shown in a locked position with the retaining walls.

Turning now to FIGS. 4A-4C, movement of the latch 62 from the unlocked position (FIG. 3C) to the locked position (FIG. 3A) will be described. In one method, direct manipulation of the user actuated portion 72 is not necessary to move the latch 62 into the locked position. In such a method, a user may urge the lid portion 20 in the direction $D_3$. The engaging members 76 each define ramped surfaces 130 for slidably negotiating along complimentary ramped surfaces 132 defined on the pockets 46. Slidable movement of the engaging members 76 along the ramped surface 132 of the pockets 46 urges the latch 62 in the direction $D_2$. Once the engaging members 76 clear the respective ramped surfaces 132, the biasing member 64 urges the latch 62 in the direction $D_4$ drawing the engaging members 76 under the respective retaining walls 80. Sufficient force must be exerted onto the lid 20 to overcome the biasing force of the biasing member 64.

In an alternate method, a user may manually actuate the latch 62 in the direction $D_2$ until the engaging members reach a position beyond the retaining walls 80 of the pockets 46. The latch 62 may subsequently be moved in the direction $D_3$ into the pockets 46 until the engaging members 76 extend beyond the retaining walls 80. At this point, the user actuated portion 72 of the latch 62 may be released whereby the biasing member 64 urges the latch 62 in the direction $D_4$ into the locked position (FIG. 4B).

The latch assembly 10 is configured to cooperate with the track 66 for easy installation during assembly. Specifically, the extension portions 84 on the inner surface 86 of the lid portion 20 are arranged such that the latch 62 may be easily installed into the track 66 without the use of tools or supplemental fasteners. In this way, the spring 64 may be located between respective posts 104 and 106 and moved to a compressed state. At this point, the connecting bar 74 may be inserted through the receiving gap 126 (FIG. 2) and toward the inner surface 86 of the lid portion 20. Once the user actuated portion 72 is located on the slide surface 122, the latch 62 may be released allowing the spring 64 to influence the latch 62 into the locked position (FIG. 3A).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A storage container comprising:

a first container portion having a contact surface;

a second container portion hingedly attached to said first container portion; and a latch slidably disposed on said first container portion and movable between a safety position wherein slidable movement of said latch relative to said first container is precluded and a free position wherein said latch is free to slide relative to said first container, said latch including a main body having a user actuated portion, a pair of engaging members, and a locating finger extending therefrom, said locating finger adapted to engage said contact surface and thereby preclude actuation of said latch while in said safety position, wherein depression of said user actuated portion in a first direction toward said first container portion causes said locating finger to move away from engagement with said contact surface and into said free position;

wherein said user actuated portion is moveable in said free position in a second direction, substantially perpendicular to said first direction, between a locked position wherein said engaging members engage said first container portion to said second container portion and an unlocked position wherein said engaging members disengage said first container portion from said second container portion.

2. The storage container of claim 1 wherein said main body portion defines opposite ends, wherein each of said pair of engaging members extend from said opposite ends respectively.

3. The storage container of claim 2 wherein said user actuated portion extends from said main body portion adjacent to an outer surface of said first container portion.

4. The storage container of claim 3 wherein said main body portion of said latch extends adjacent to an inner surface of said first container portion.

5. The storage container of claim 4 wherein said inner surface of said first container portion includes a plurality of extension portions collectively defining a track, wherein said main body portion is slidably disposed in said track and selectively translatable in said track between said locked and unlocked positions.

6. The storage container of claim 3 wherein said user actuated portion of said latch is biased toward said safety position.

7. The storage container of claim 6 wherein said user actuated portion of said latch defines an arcuate body portion having an intermediate portion and opposite ends, wherein said opposite ends engage said outer surface of said container to bias said locating finger into said safety position, wherein deflection of said intermediate portion toward said outer surface urges said locating finger into said free position.

8. The storage container of claim 5, further comprising a biasing member disposed between said latch and said first container portion and adapted to bias said latch toward said locked position.

9. The storage container according to claim 1, wherein said second container portion includes at least one internal lateral divider wall having a series of locating tabs extending therefrom.

10. The storage container according to claim 9, further comprising at least one removable spacer for selectively positioning between said locating tabs.

11. The storage container according to claim 10, wherein said removable spacer includes a first and second side having a first and a second end, said first and second sides being flared outwardly at said first and second ends.

12. The storage container of claim 11, further comprising a third container portion, wherein said first container portion defines a lid, said second container portion defines an intermediate storage cavity and said third container portion defines a base storage cavity, wherein said second and third container portions are hingedly coupled.

13. A storage container comprising:

a first container portion;

a second container portion hingedly attached to said first container portion; and a latch disposed on the storage container and defining a user actuated portion extending generally outboard of said first container portion, said latch moveable between a locked position wherein said first container portion is secured to said second container portion and an unlocked position wherein said first container portion is free to rotate relative said second container portion;

wherein said user actuated portion is subjected to a first biasing force adapted to inhibit movement of said user actuated portion in a first direction and a second biasing force adapted to inhibit movement of said latch in a second direction, wherein movement of said user actuated portion into said unlocked position is accomplished by sequential movement of said user actuated portion in said first direction followed by movement of said user actuated portion in said second direction, said second direction being distinct from said first direction.

14. The storage container of claim 13 wherein said latch defines a main body portion having said user actuated portion and a locating finger, wherein said user actuated portion exerts said first biasing force onto said latch.

15. The storage container of claim 14 whereby said locating finger is urged into a contact surface of said first container portion in said locked position thereby precluding movement of said latch toward said unlocked position.

16. The storage container of claim 15 wherein a biasing member is disposed between said main body portion and said first container portion, said biasing member exerting said second biasing force.

17. A storage container comprising:

a first container portion;

a second container portion hingedly coupled to said first container portion;

a latch moveable between a locked position wherein said first container portion is secured to said second container portion and an unlocked position wherein said first container portion is free to rotate relative said second container portion;

a user actuated portion extending generally outboard of said first container portion and defining a first biasing member that provides a first biasing force, said user actuated portion biasing said latch into a safety position wherein said latch is precluded from movement toward said unlocked position; and a second biasing member providing a second biasing force onto said latch;

wherein movement of said latch from said locked position to said unlocked position requires movement of said user actuated portion in a first direction to overcome said first biasing force and subsequent movement of said user actuated portion in a second direction to overcome said second biasing force, wherein said second direction is distinct from said first direction.

18. The storage container of claim 1 wherein movement of said latch toward said unlocked position is only permitted subsequent to movement of said latch into said free position.

* * * * *